US007866714B2

(12) United States Patent
Mönig et al.

(10) Patent No.: US 7,866,714 B2
(45) Date of Patent: Jan. 11, 2011

(54) EXTERIOR DOOR HANDLE FOR A MOTOR VEHICLE

(75) Inventors: Stefan Mönig, Schwelm (DE); Dirk Müller, Essen (DE); Manfred Rohlfing, Velbert (DE)

(73) Assignee: Huf Hulsbeck & Furst GmbH & Co. KG, Velbert (DE)

( * ) Notice: Subject to any disclaimer, the term of this patent is extended or adjusted under 35 U.S.C. 154(b) by 690 days.

(21) Appl. No.: 11/792,412

(22) PCT Filed: Nov. 16, 2005

(86) PCT No.: PCT/EP2005/056015

§ 371 (c)(1),
(2), (4) Date: Jun. 6, 2007

(87) PCT Pub. No.: WO2006/061312

PCT Pub. Date: Jun. 15, 2006

(65) Prior Publication Data

US 2008/0084074 A1 Apr. 10, 2008

(30) Foreign Application Priority Data

Dec. 6, 2004 (DE) ..... 10 2004 058 874

(51) Int. Cl.
*E05B 3/00* (2006.01)
*E05B 13/10* (2006.01)

(52) U.S. Cl. ..... 292/336.3; 70/208

(58) Field of Classification Search ..... 292/336.3; 70/208

See application file for complete search history.

(56) References Cited

U.S. PATENT DOCUMENTS

| | | | | |
|---|---|---|---|---|
| 4,482,179 | A * | 11/1984 | Johnson | 292/336.3 |
| 4,778,206 | A * | 10/1988 | Matsumoto et al. | 292/201 |
| 5,632,516 | A * | 5/1997 | Schwab | 292/336.3 |
| 5,743,575 | A * | 4/1998 | McFarland | 292/336.3 |
| 5,844,470 | A * | 12/1998 | Garnault et al. | 340/5.62 |
| 6,072,403 | A * | 6/2000 | Iwasaki et al. | 340/5.72 |
| 6,181,024 | B1 * | 1/2001 | Geil et al. | 307/10.2 |
| 6,406,075 | B1 | 6/2002 | Rice et al. | |
| 6,698,262 | B2 * | 3/2004 | Wittwer | 70/208 |
| 6,874,829 | B2 * | 4/2005 | Muller | 292/336.3 |
| 7,005,959 | B2 * | 2/2006 | Amagasa et al. | 340/5.3 |
| 2001/0005082 | A1 | 6/2001 | Suparschi | |
| 2003/0019261 | A1 | 1/2003 | Wittwer | |

FOREIGN PATENT DOCUMENTS

| | | |
|---|---|---|
| DE | 100 08 515 A1 | 8/2001 |
| DE | 100 15 887 C1 | 1/2002 |
| EP | 1 312 734 A1 | 5/2003 |
| EP | 1 408 187 A1 | 4/2004 |
| FR | 2 802 562 A | 6/2001 |

* cited by examiner

*Primary Examiner*—Carlos Lugo
(74) *Attorney, Agent, or Firm*—Miles & Stockbridge P.C.; David R. Schaffer, Esq.

(57) ABSTRACT

An exterior door handle for a motor vehicle, including an electromechanical locking system and a manually actuated handle part that can perform a lifting movement in order to open a door lock. The lifting movement of the handle part is subdivided, a device generating an increased actuation resistance and a switch electrically opening the door lock at the end of a first lifting distance. The handle part can travel an additional lifting distance beyond the first lifting distance in case the electric power supply is interrupted or the electric locking system breaks down, the additional lifting distance mechanically opening the door lock.

7 Claims, 3 Drawing Sheets

EXTERIOR DOOR HANDLE FOR A MOTOR VEHICLE

The invention is directed to an exterior door handle for a motor vehicle.

BACKGROUND OF THE INVENTION

An exterior door handle comprising two pivot levers projecting from a handle part and each being pivotable by their free end about a common pivot axis in a handle housing is known, for example, from DE 100 15 887 C. Upon a lifting or pulling movement applied to the handle part, the door lock of a motor vehicle door can be opened. With electromechanical locking systems there is a problem that in the event of a system failure or a power breakdown access to the motor vehicle is precluded.

SUMMARY OF THE INVENTION

Thus, it is an object of the invention to provide an exterior door handle for a motor vehicle, wherein access to the interior of the vehicle is still possible in the event of a system or power breakdown.

The invention advantageously provides that the lifting movement of the handle part is divided, wherein at the end of a first lifting distance a means causes an increased actuation resistance and a switch opens the lock electrically, the handle part being adapted to travel an additional lifting distance beyond the first lifting distance to mechanically open the door in the event of a failure of the electric power supply or of the electric locking system.

Such an exterior door handle may be operated in the usual manner, the increased actuation resistance at the end of the first lifting distance and the electric opening of the door lock giving the operator the known impression of a mechanical opening of the door.

In the event of a failure of the electric power supply or another failure of the electric part of the locking system, the handle part can be operated further beyond the first lifting distance to mechanically open the door lock in a manner known per se. To this end, a pivot lever of the handle part actuates a pivot lever that opens the lock mechanically via a Bowden wire.

At the end of the first lifting distance, a device acts on the handle part that rapidly increases the actuating resistance in the form of a pressure point that is perceivable at the handle part and has to be overcome, the pressure point being followed by a stop.

The device for increasing the actuation resistance is formed by at least one damping means deformable under pressure, the deformation requiring an elevated force threshold to be overcome first.

The switch for an electric actuation of the door lock preferably opens after or upon overcoming the pressure point of the door lock generated by the means for increasing the actuation resistance.

The electric switch may be a microswitch, a Hall effect sensor, a capacitive sensor, a Reed switch, or an acceleration sensor.

The means for increasing the actuation resistance may be formed by a plate mechanically rigidly connected with the handle part or a pivot lever of the handle part, wherein the plate, at the end of the first lifting distance, acts on a damping means formed by at least one cup-like deforming element of elastic material. The cup-like deforming element, preferably made of rubber material, is adapted to change its shape abruptly, wherein the effort for deforming can for a short time increase to a multiple, e.g. four times, of the effort for pivoting the handle part. After the damping means has been compressed, a stop is felt upon actuating the handle, which is caused by one of the pivot levers of the handle part abutting against a pivot lever for a mechanical actuation of the door lock, the latter lever being spring-biased in the opposite direction. The damping means is coupled to a pivot lever for a mechanical opening of the door lock.

When the lifting movement is continued, the handle part can take the pivot lever for a mechanical opening of the door lock along beyond the stop formed by the damping means, so as to open the door lock mechanically via a Bowden wire coupled to the pivot lever.

An alternative solution provides that, when the power supply is functional, a lifting magnet with a locking pin limits the lifting movement of the handle part to the first lifting distance by forming a stop using the locking pin, and that in the event of a power breakdown, the lifting magnet withdraws the locking pin and releases the handle part for an additional lifting distance to open the door lock mechanically.

Summarizing, the invention advantageously allows an exterior door handle to open a door in the usual manner with an actuating feeling known to a user, when the electromechanical locking system is functional. In the event of a power failure or a system breakdown, e.g. a failure of a control line, further pulling or lifting the exterior door handle will open the door in a purely mechanical manner by using a mechanical key and lifting the handle part fully.

If only a control line of the electromechanical locking system or merely an electrical switch of the electromechanical locking system is defect, the vehicle may still be started.

The invention is applicable to all kinds of exterior door handles and, in particular, not limited to hinged handles. It is suited also for pull handles and pull/pivot handles with an inclined pivot axis or pull handles with a substantially vertical pivot axis.

The following is a detailed description of an embodiment of the invention with reference to the drawings.

DETAILED DESCRIPTION OF THE INVENTION

Figure 5:
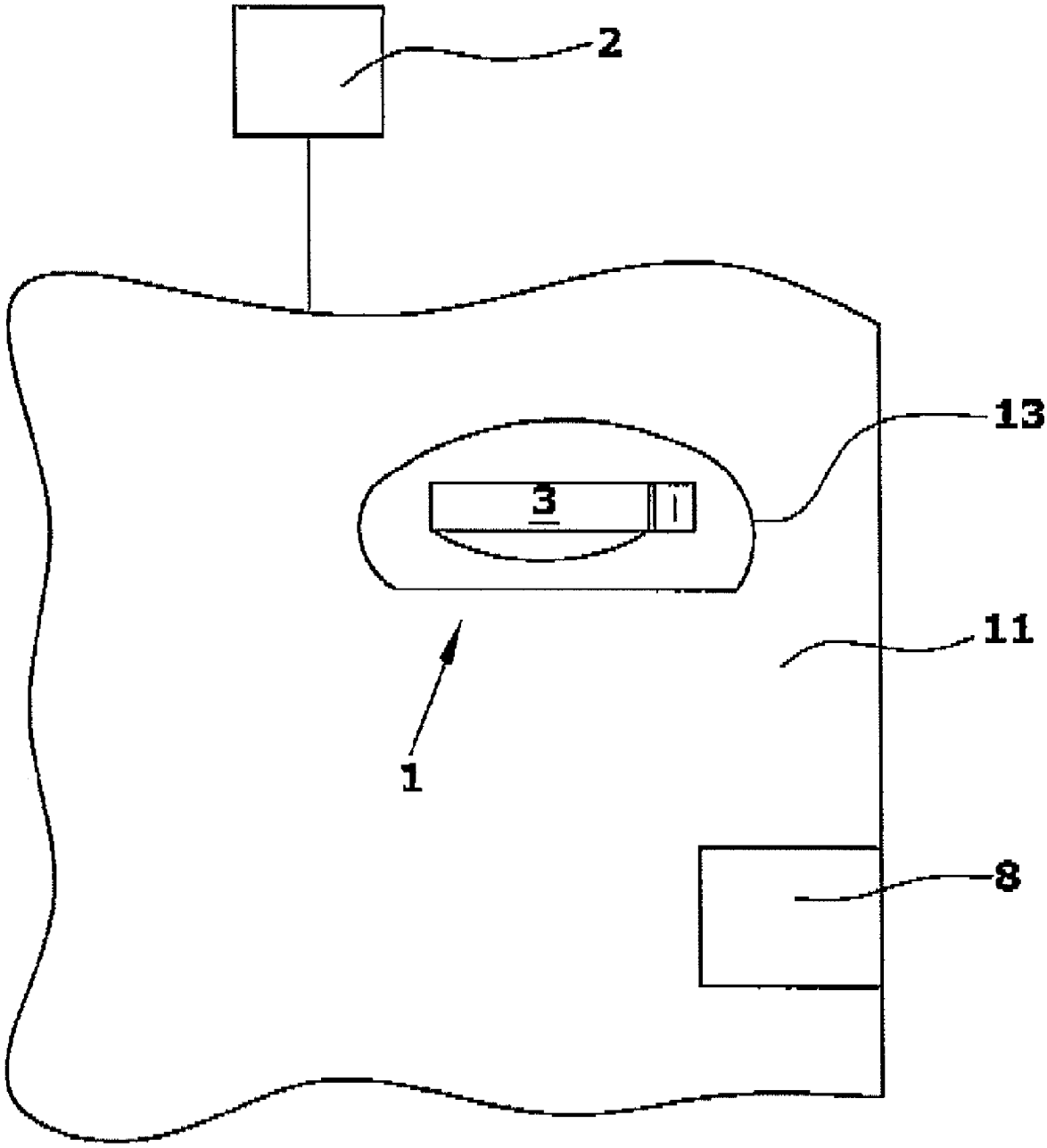
FIG. 5 shows a vehicle door with an exterior door handle.

FIG. 5 shows a detail of a door 11 of a motor vehicle comprising an exterior door handle 1 that has a manually operable handle part 3. The handle part 3 may be operated to open the door lock by a lifting or pulling movement. To open the vehicle door 11, an electromechanical locking system 2 is activated by means of which the door lock 8 can be opened and closed. The handle part 3 comprises two mutually spaced pivot levers 4*a*, 4*b* pivotable about a common axis 5 in the handle housing 13. To realize a pivot/pull handle, the axis 5 may also extend not in parallel with the handle part 3.

At least one of the pivot levers 4*a*, 4*b* may be provided with a means 9 for increasing the actuation resistance, which engages at the end of a first lifting distance 21.

Figure 1:
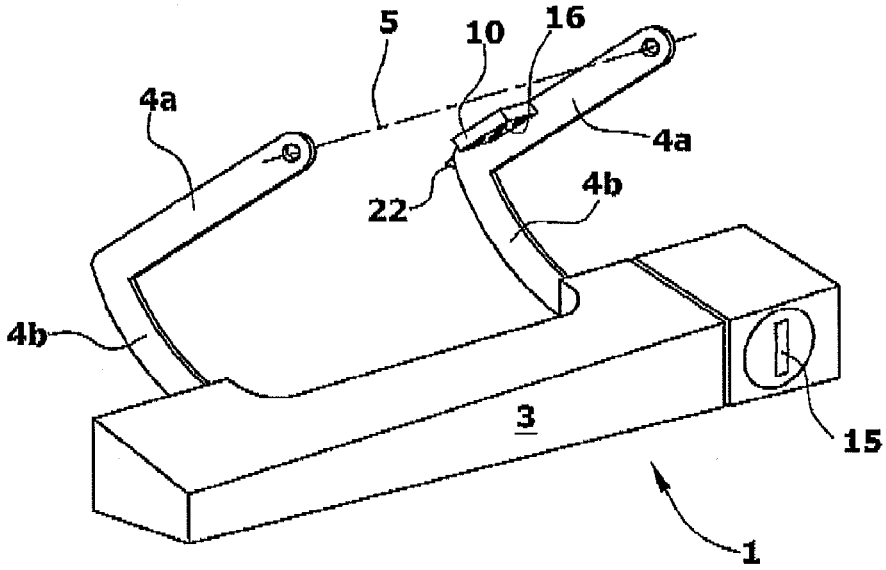
FIG. 1 shows an exterior door handle.
Figure 2:
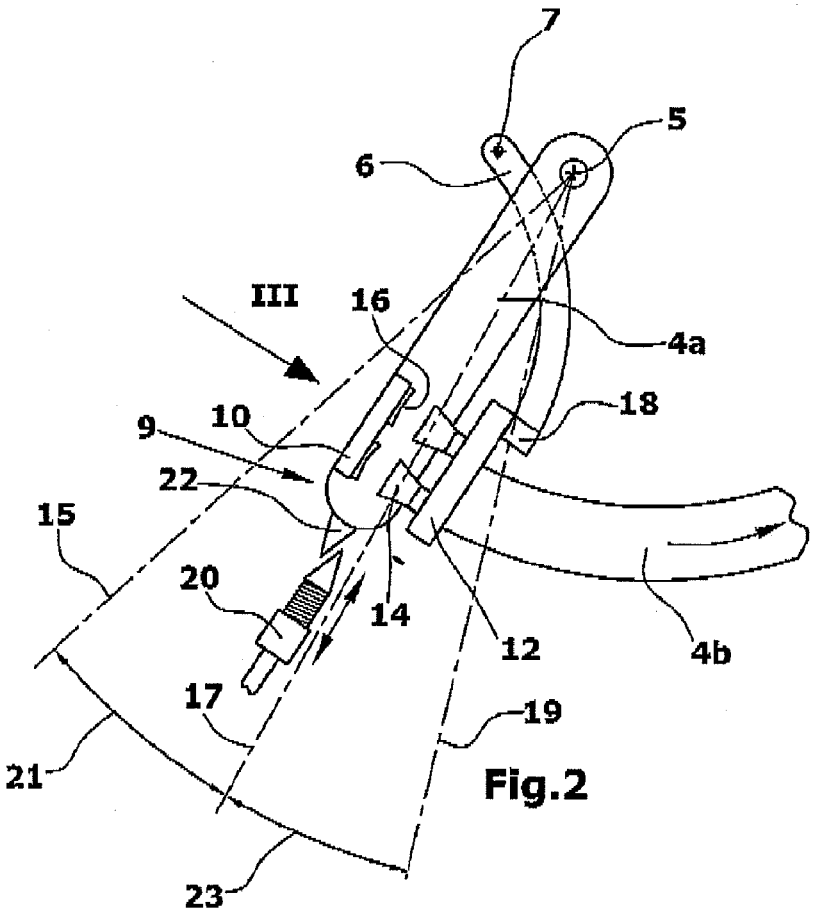
FIG. 2 is a side elevational view of the pivot lever of the handle part and the pivot lever for a mechanical actuation of the door lock.

As obvious from FIGS. 1 and 2, the means for increasing the actuation resistance is arranged at the lower end of the pivot lever part 4*a* and specifically comprises a plate 10 rigidly connected to the pivot lever part 4*a*, the plate having protrusions 16 acting on cup-like deforming elements 14 at the end of the first lifting distance 21, wherein an elevated force threshold has to be overcome first to obtain a deformation. The cup-like deforming elements 14 of elastic material deform in the manner illustrated in FIGS. 4*a*, 4*b*, wherein an increased actuation force has to be exerted to flatten the upper part of the deforming elements. This increased actuation force can be felt as a pressure point to be overcome when operating the handle part 3, so that the operator is given the impression of a mechanical opening of the door lock 8.

Upon deformation of the cup-like deforming elements or shortly after having overcome the pressure point, a switch 20 is actuated by a protrusion 22 at the lower end of the pivot lever 4*a*.

FIG. 2 shows the pivot lever 4*a*, 4*b* in a position shortly before the end of the first lifting movement 21. The angular positions drawn in FIG. 2 refer to the pivot lever part 4*a* and illustrate its position at rest 15, in a middle position 17 at the end of the first lifting distance 21, and in an end position 19 at the end of the additional lifting distance 23 after the mechanical opening of the door lock 8.

The cup-like deforming elements 14 of elastic material, preferably a rubber material, are arranged on a supporting plate 12 connected to another pivot lever 6 via a transverse web 18. The pivot lever 6 serves the mechanical opening of the door lock 8 when the handle part 3 with the pivot lever part 4*a* is pivoted beyond the middle position 17. A spring 28 supported in the housing 13 biases the pivot lever 6 in a direction opposite to the actuation direction of the handle part 3 shown in FIG. 2, so that the pivot lever 6, together with the supporting plate 12 and the deforming elements 14 fixed thereon, forms a surmountable stop for the first lifting distance 21.

The pivot lever 6 is pivotable about a pivot axis 7 supported in the housing 13, a Bowden wire receptacle 30 for a Bowden wire 32 being attached to the pivot lever 6 so that upon a pivot movement of the pivot lever 6 the Bowden wire 32 is operated to open the door lock 8 mechanically.

Figure 3:
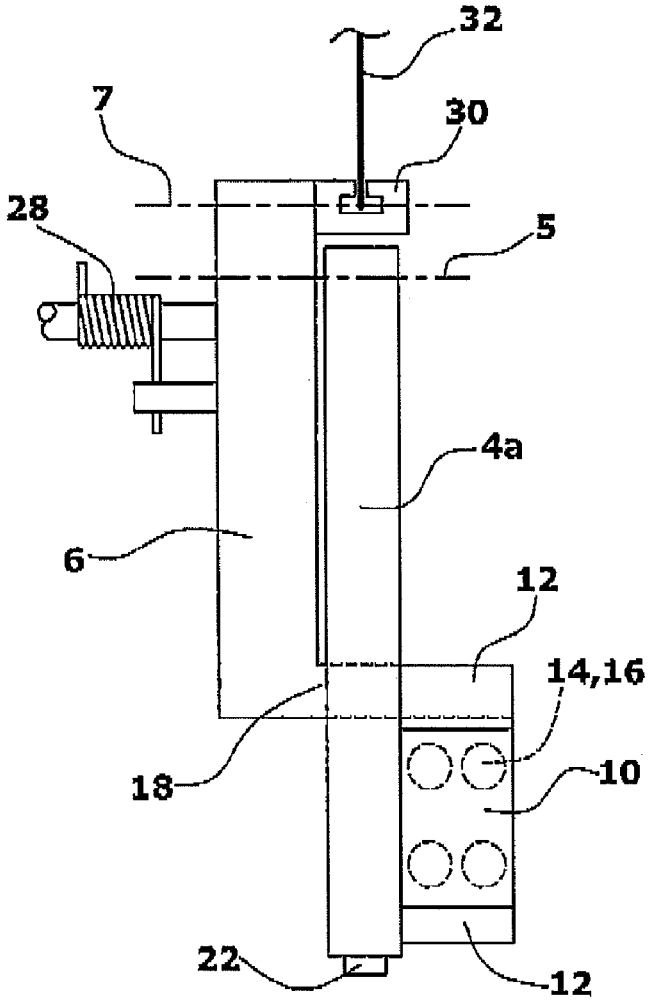
FIG. 3 is a view on the pivot levers in FIG. 2 in the direction of the arrow 3 in FIG. 2.

The pivot movement of the pivot lever 6 is started if, in the event of a power breakdown or a failure of an electric component of the locking system, the handle part 3 is pivoted further beyond the first lifting distance 21 by, as is best seen in FIG. 3, the pivot lever part 4*a* taking along the transverse web 18 of the pivot lever 6.

Thus, in case of a power breakdown or a failure of a control line of the locking system 2, it is possible to operate the locking cylinder 15 with a mechanical key and to open the door mechanically by actuating the handle part 3.

As can be seen in FIG. 3, four deforming elements may be arranged on the supporting plate 12, for example.

Figure 4A:
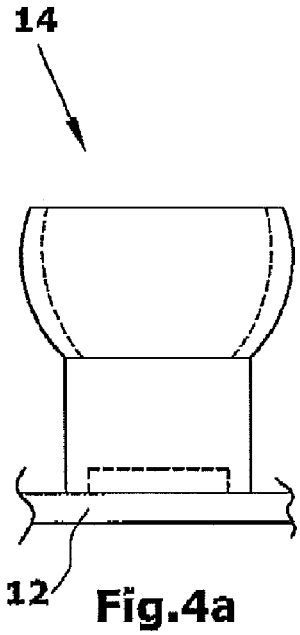
FIGS. 4*a*, 4*b* show components of the means for increasing the actuation resistance.
Figure 4B:
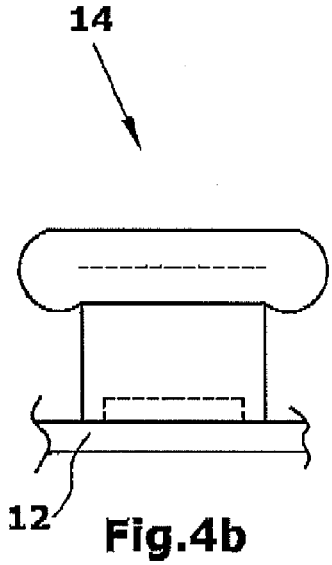

The advantage of the deforming elements shown in FIGS. 4*a* and 4*b* is that an elevated force threshold has to be overcome first in order to flatten the cup-like portion of the deforming element.

Thereby, when operating the handle part 3, a feeling of overcoming a pressure point at the end of the first lifting distance 21 is created so that the process of opening a door 11, with the locking system 2 fully functional and the power supply uninterrupted, can be finished after having overcome the pressure point and after an electrical opening of the door lock 8.

Although a preferred embodiment of the invention has been specifically illustrated and described herein, it is to be understood that minor variations may be made in the apparatus without departing from the spirit and scope of the invention, as defined by the appended claims.

What is claimed is:

1. An exterior door handle (1) for a motor vehicle with an electromechanical locking system (2) comprising a manually operable handle part (3) adapted to make a lifting movement to open a door lock (8) of a door (11), wherein the lifting movement of the handle part (3) being subdivided into a first lifting distance (21) and an additional lifting distance (23), a means (9) for generating an increased actuation resistance at the end of the first lifting distance (21) and a switch (20) being actuated by the handle part (3) to open the door lock (8) electrically when the handle part (3) reaches the first lifting distance, wherein, in case of a breakdown of the electric power supply or of the electric part of the locking system (2), the handle part (3) being adapted to travel the additional lifting distance (23) beyond the first lifting distance (21), thereby opening the door lock (8) mechanically, wherein the means (9) for generating an increased actuation resistance being formed by a plate (10) coupled to the handle part (3), said plate acting on a damping means (14) at the end of said first lifting distance (21), said damping means (14) being formed by at least one cup deforming element (14) of an elastic material, and said damping means (14) being coupled to a pivot lever (6) for the mechanical opening of the door lock (8).

2. The exterior door handle of claim 1, wherein at the end of the first lifting distance (21) the means (9) for generating an increased actuation resistance acts on the handle part (3), which increases the actuation resistance for a short time in the manner of a pressure point with a subsequent stop, wherein the pressure point is perceivable in the handle part (3) and has to be overcome.

3. The exterior door handle of claim 1, wherein the switch (20) opens the door lock (8) electrically after or upon overcoming the pressure point generated by the means (9) for increasing the actuation resistance.

4. The exterior door handle of claim 1, wherein the electric switch (20) is a microswitch, a Hall effect sensor, a capacitive sensor, a Reed switch, or an acceleration sensor.

5. An exterior door handle (1) for a motor vehicle with an electromechanical locking system (2) comprising:

a manually operable handle part (3) adapted to make a lifting movement to open a door lock (8) of a door (11), the lifting movement of the handle part (3) being subdivided into a first lifting distance (21) and an additional lifting distance (23), a means (9) for generating an increased actuation resistance at the end of the first lifting distance (21), and a switch (20) being adapted to be actuated by the handle part (3) to open the door lock (8) electrically when the handle part (3) reaches the first lifting distance, wherein, in case of a breakdown of the electric power supply or of the electric part of the locking system (2), the handle part (3) being adapted to travel the additional lifting distance (23) beyond the first lifting distance (21), thereby opening the door lock (8) mechanically, wherein the means for increasing the actuation resistance being formed by a plate (10) coupled to the handle part (3), said plate (10) acting on at least one damping means (14) deformable under pressure, the deforming requiring an elevated force threshold to be overcome first at the end of said first lifting distance (21), and the damping means (14) being coupled to a pivot lever (6) for the mechanical opening of the door lock.

6. The exterior door handle of claim 5, wherein the handle part (3) takes along the pivot lever (6) for a mechanical opening of the door lock when the lifting movement (23) is continued beyond the stop formed by the damping means (14), so as to open the door lock mechanically by means of a Bowden wire (32) connected with the pivot lever (6).

7. The exterior door handle of claim 2, wherein the switch (20) opens the door lock (8) electrically after or upon overcoming the pressure point generated by the means (9) for increasing the actuation resistance.

* * * * *